United States Patent [19]

Baier

[11] Patent Number: 4,691,753

[45] Date of Patent: Sep. 8, 1987

[54] ROLL SHUTTER FOR HINGED-CASEMENT TYPE ROOF WINDOWS

[76] Inventor: Paul Baier, Reiersbacher Str. 108, D-7592 Renchen, Fed. Rep. of Germany

[21] Appl. No.: 945,205

[22] Filed: Dec. 22, 1986

Related U.S. Application Data

[63] Continuation of Ser. No. 729,959, May 2, 1985, abandoned.

[51] Int. Cl.[4] ..... E06B 9/10

[52] U.S. Cl. ..... 160/32; 160/133; 160/265

[58] Field of Search ..... 160/31, 32, 33, 29, 160/30, 265, 133, 319, 320, 321

[56] References Cited

U.S. PATENT DOCUMENTS

| | | | |
|---|---|---|---|
| 983,663 | 2/1911 | White | 160/265 X |
| 1,546,848 | 7/1925 | Lundgren | 160/319 |
| 3,097,688 | 7/1963 | Schwartz | 160/30 |
| 3,180,401 | 4/1965 | Gambon et al. | 160/321 X |
| 4,494,707 | 1/1985 | Niibori et al. | 160/265 X |

FOREIGN PATENT DOCUMENTS

| | | | |
|---|---|---|---|
| 2842381 | 4/1980 | Fed. Rep. of Germany | 160/33 |
| 3115926 | 11/1982 | Fed. Rep. of Germany | 160/33 |

*Primary Examiner*—Ramon S. Britts
*Assistant Examiner*—David M. Purol
*Attorney, Agent, or Firm*—Wigman & Cohen

[57] ABSTRACT

The present invention relates to a roll shutter for hinged casement type roof windows, which includes two guide rails (14) for the roll shutter bars (12), which guide rails (14) run parallel to each other and are connected to the shutter and is provided with a roll shutter activation device which includes a first and a second control cable (40 and 42) as well as a third control cable (50). The first and the second control cables (40 and 42) are led to a connection point (47) and are attached to each other. The connection point (47) is also connected with the third control cable (50) which is guided from a spool (26) on the winding shaft (24) of the roll shutter, through an activation loop (59) accessible to the user and an adjoining buffer loop (43) to the connection point (43). The length of the buffer loop (43) is at least as large as the displacement path of the roll shutter (10) between its completely open and completely closed positions.

12 Claims, 4 Drawing Figures

ROLL SHUTTER FOR HINGED-CASEMENT TYPE ROOF WINDOWS

This is a continuation of co-pending application Ser. No. 729,959 filed on May 2, 1985, now abandoned.

The invention relates to a roll shutter for roof windows of the hinged casement type, having a roll shutter frame in which a winding shaft is arranged which supports the portion of the shutter plating that is to be wound up. It has two parallel guide rails connected to the shutter frame, each of which guide rails forms a guide groove for the ends of the shutter bars and which are divided at equal distances by the shutter frame. The upper sections of the guide rails connected to the shutter frame are connected with the lower sections by respective hinges, the pivot axes of which run parallel to the pivot axis of the hinged casement, and which are connected with each other at their ends opposite the shutter frame by a cross rail. A shutter activation device is provided with a first and a second control cable attached to the lower end of the shutter is at equal distances from the center of the shutter and each running in one of the respective guide grooves in the guide rails, past diverting elements provided in the area of the cross rails. They are connected with the end of an activating loop, which can be grasped by the user, through bores penetrating the frame of the hinged casement, which loop, in turn, is connected with the windup shaft by means of a third control cable, which also passes through a bore in the frame of the hinged casement. When the shutter is closed, the end of this third control cable is wound onto a spool fixed to the winding shaft.

In known roll shutters of this type both the first control cable and the second control cable can be grasped in the activating loop accessible to the user as soon as the roll shutter has been pulled down by some variable degree from the completely opened position. In this case the user must exert a uniform pull on both the first and second control cables to complete the closing of the roll shutter. For example, if one were to pull only on the first or second control cable, the roll shutter would wedge itself in the guide rails, so that any additional closing or drawing down, and perhaps even an opening movement would not be possible because of the jamming.

SUMMARY AND OBJECTS OF THE INVENTION

The object of the invention is to create a roll shutter of the above-mentioned type in which the danger of jamming while the shutter is being pulled down or closed is avoided. This object is achieved by a roll shutter having the characteristics of the invention.

The connection points, at which the first and second control cables are connected to each other and with the third control cable, one end of which is wound onto the spool of the winding shaft, is located in the invention at any roll shutter positions within a buffer loop that is not accessible to the user and is present in addition to the activation loop. Thus, only the third control cable appears in the activating loop, by means of which control cable the closing and opening movements of the roll shutter can be controlled in a simple manner without danger of jamming.

In a preferred exemplary embodiment the buffer loop extends within the lower cross rail from corner area to corner area, i.e. each of the loop-forming rolls is arranged in one of the corner areas neighboring the adjacent guide rail.

An additional object of the invention is to secure the upper sections of the guide rails in a simple manner in a position where they are at least adjacent the sides of the window frame. In the invention, this is accomplished by means of two mounting bolts, each of which overlaps the respective upper side edge areas of each of the sections. These mounting bolts are rigidly connected with the associated sides of the window frame.

In an additional preferred exemplary embodiment the connection of the mounting bolts with the sides of the window frame take place by means of elongated mounting rails, which extend at the sides along the upper section of the guide rails of the roll shutter and form a light shield, in order to prevent a lateral incidence of light between the window frame and the guide rails when the upper section of the guide rails separates slightly from the window frame. A slight separation can result when a small intermediate space is present between the mounting bolts and the upper side of the sections of the guide rails.

A further object of the invention is to form the shutter frame in such a manner that its interior space, in rough contour, seats the round form of the coiled shutter plating located therein. This is achieved in the invention in that the wall of the shutter frame is divided into a plurality of flat wall sections, with adjacent wall sections forming obtuse angles with each other.

In an additional preferred exemplary embodiment, a plastic strip with a triangular cross-section extending along the corner area is placed in the interior space of the shutter frame in a corner area in which interior wall section of the shutter frame abut each other to form a right angle and acts as a shaping structural element.

BRIEF DESCRIPTION OF THE DRAWINGS

The invention is described in greater detail below with the aid of an exemplary embodiment illustrated in the drawings.

Shown are.

DETAILED DESCRIPTION OF A PREFERRED EMBODIMENT

Figure 3:
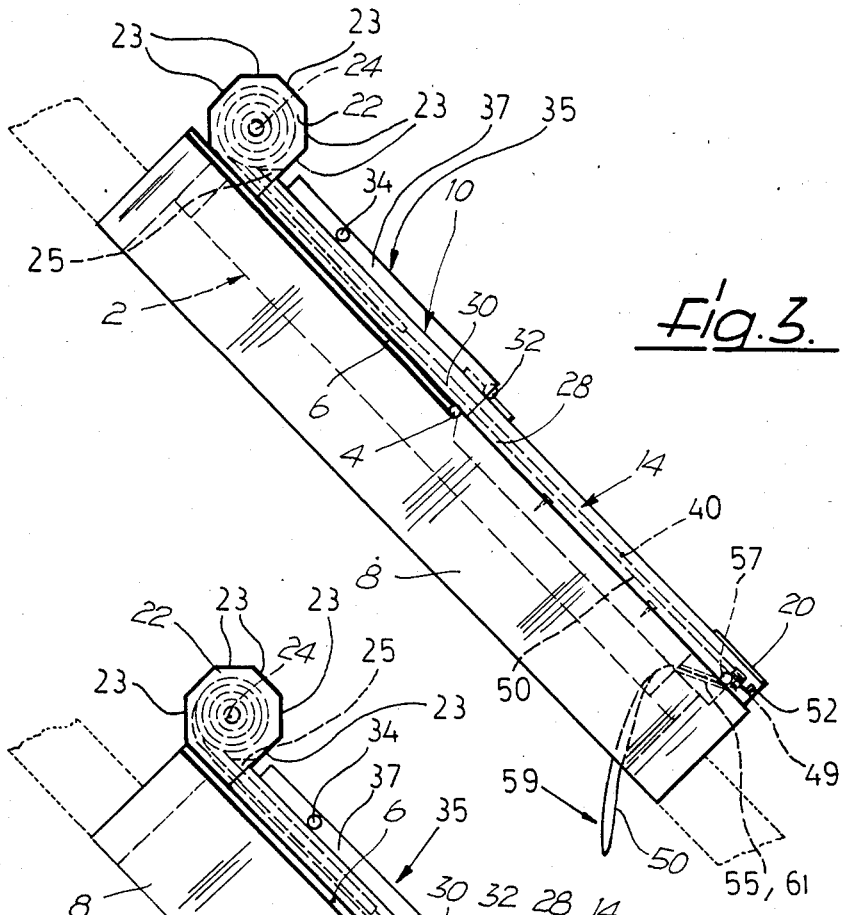
FIG. 3 is a side view of the exemplary embodiment with a closed hinged casement.
Figure 4:
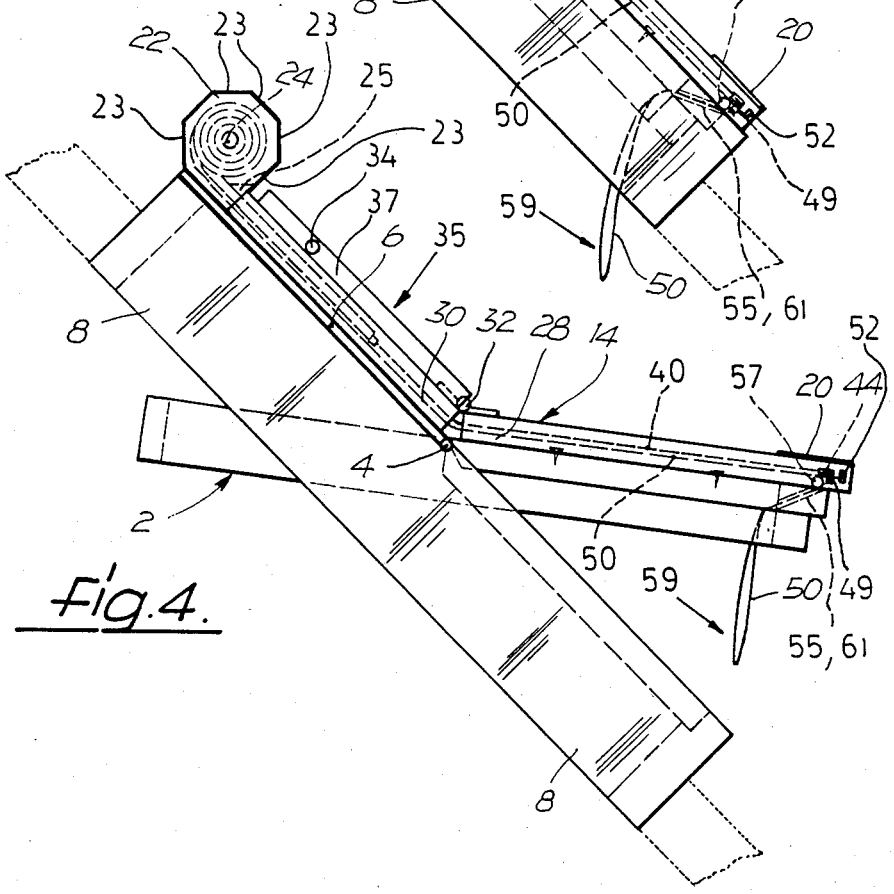
FIG. 4 is a side view of the exemplary embodiment with an open hinged casement.

As shown particularly in FIGS. 3 and 4, the shutter, designated generally with the numeral 10, is formed for placement on the outside of a roof window in a hinged casement design. The hinged casement of this roof window is designated with the numeral 2. The two hinge mounts 4, which support the hinged casement 2, are provided on the lower end of each supporting side piece 6. The latter can be formed by a portion of the side of the stationary window frame 8. However, these can also be rails or the like, which are also provided at the sides of the window frame 8.

Figure 2:
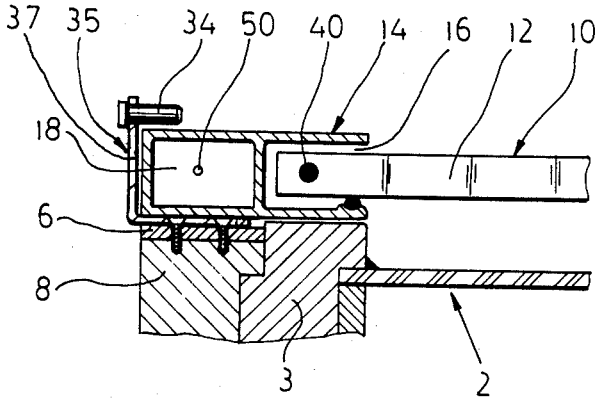
FIG. 2 is a cross-sectional view along the line II—II in FIG. 1.

The shutter plating, which is formed of individual shutter bars 12 of equal length, is guided at the sides by two guide rails 14, which are rails made of a light metal. As FIG. 2 shows with respect to one of the two identical, mirror-image guide rails 14, these rails form a guide groove which is rectangular in cross-section as well as a chamber 18, which is also rectangular in cross-section and is adjacent the base of the groove.

Figure 1:
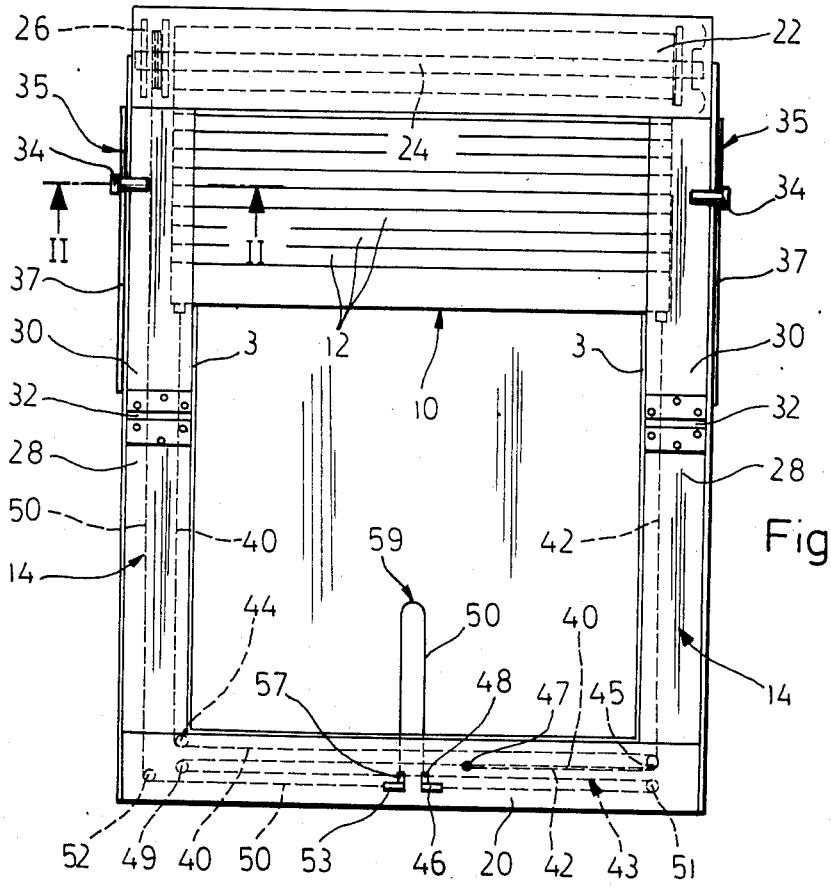
FIG. 1 is a top view of the exemplary embodiment in a partially opened condition.

The lower ends of the two guide rails 14 are rigidly connected with a cross rail 20 and the upper ends thereof are rigidly connected with a shutter frame 22, the underside of which lies in the plane defined by the underside of the guide rails and which therefore projects beyond the front side of the guide rails. A winding shaft 24 for the plating formed by the shutter bars 12 is rotatably mounted in the shutter frame 22. The shutter frame 22 does not have the usual rectangular or square cross-sectional shape, but rather has, as shown particularly in FIGS. 3 and 4, a cross-sectional shape which approximates a circle. In the present exemplary embodiment this is achieved in that the wall of the shutter frame 22 is divided into a plurality of flat wall sections 23, adjacent wall sections 23 of which form obtuse angles with each other. In order to adapt the interior chamber of the shutter frame 22 particularly well to the round shape of the coil of the shutter plating located on the winding shaft 24, a plastic strip 25 having a triangular cross section is located in the interior chamber of the frame 22 at the only perpendicular corner of the interior chamber of the shutter frame, namely the corner at the exit of the shutter plating from the shutter frame 22. As shown in FIG. 1, a spool 26 is arranged near one end of the winding shaft 24, which spool 26 is directed toward the chamber 18 of the guide rail 14 connected to this end of the shutter frame 22.

The frame formed by the two guide rails 14, the shutter frame 22 and the cross rail 20, as shown in FIG. 1, is placed from the outside onto the roof window during mounting in such a manner that the guide rails 14 are aligned with the sides 3 of the hinged casement or supporting side pieces 6 and the cross rail 20 is aligned with the lower piece of the hinged casement 2. As shown in FIG. 4, the cross rail 20 projects downward somewhat beyond the lower piece of the hinged casement 2.

As shown particularly in FIG. 4, the two guide rails 14 are divided into lower sections 28 and upper sections 30, respectively, at the level of the hinge mount 4 of the hinged casement 2. The two sections are connected with each other at the point of division by a pair of hinges 32. The axes of the two hinges 32, which are aligned with each other, form a folding axis lying parallel to the pivot axes of the hinged casement and lying adjacent thereto on the outside of the casement.

The lower section 28 of both guide rails 14 is rigidly connected during mounting with the sides 3, for example by means of screws. Because the two upper sections 30 must be movable relative to the supporting side pieces 6 in order to be able to carry out the necessary compensating movement during a pivoting of the hinged casement 2, which is a longitudinal shifting relative to the supporting side pieces 6, respective mounting bolts 34 are provided for the two guide rails 14, which bolts are rigidly connected with the adjacent supporting side pieces 6 and are rigidlly connected by means thereof with the associated sides of the window frame 8. Each mounting bolt 34 overlaps the upper side edge area of the associated section 30 of the guide rails 14, as shown in FIGS. 1 and 2, whereby a small spacing is provided as play between the mounting bolts and the upper sides of the concerned section, as can be seen from FIG. 2. This play makes it possible for the upper sections 30 of the guide rails 14 to be able to move slightly away from the supporting side pieces 6 during a pivoting motion of the hinged casement 2 in addition to the longitudinal shifting relative to the supporting side pieces 6. The possibility of a limited upward deflection assures that the pivot movements can be performed easily and without any danger of jamming.

Respective rails 35 having an L-shaped cross section are provided as supports for the mounting bolts 34, one shank of which rails 35 is attached to the upper side of the associated supporting side piece 6, for example by riveting, screwing or welding. The side piece 37 extending upwards at the side of each of the guide rails 14 supports the mounting bolts 34, whereby these mounting bolts 34 run perpendicular to the plane of the side piece 37 and parallel to the axes of the hinge mount 4 and the hinge 32. Because the shaped rail 35 extends essentially over the entire length of the upper section 30 of the guide rails 14, the side 37 of the shaped rail 35 forms a lateral light shield which prevents an unwanted incidence of light from between the upper side of the supporting side piece 6 and the underside of the sections 30 during the limited possible separation of the sections 30 from the supporting side pieces 6.

A first control cable 40 and a second control cable 42 are attached to the lower end of the shutter plating at the two end sections that engage in the guide grooves 16. As shown in FIG. 1, these two control cables run within the guide grooves to the corner area formed by the lower section 28 of the cross rail 20. Diverting rollers 44 and 45 are provided in these corner areas. Of these, as can be seen from FIG. 1, the diverting roller 44 is somewhat closer to the end of the associated guide rail section 28 than is the diverting roller 45. The control cable 40 leaving the guide groove 16 is guided over the diverting roller 44 to the other diverting roller 45, which it passes around together with the second control cable 42 coming from the shutter plating. After passing around the diverting roller 45, the two control cables 40 and 42, as can be seen from FIG. 1, run together until they reach a joining point 47, where both control cables 40 and 42 are connected with each other. At the connection point 47 a third control cable 50 is connected with the first and second control cables 40 and 42. From the connection point 47 the third control cable 50 passes through a buffer loop 43 defined by a first loop-forming roller 49 and a second loop-forming roller 51. Of these, the first loop-forming roller 49 is arranged in a position aligned with the diverting roller 44 in approximately the center area of the cross rail 20 and the loop-forming roller 51 is arranged in a position aligned with the diverting roller 45, displaced therefrom toward the lower end of the cross rail 20. From the second loop-forming roller 51, the third control cable 50 is led to a diverting device 46, which diverts the control cable 50 toward the underside of the cross rail 20. The third control cable 50 runs over an additional diverting device 48 connected to the underside of the cross rail 20 and into a bore 55 in the lower piece of the frame of the hinged casement 2, which bore 55 is covered with a guide bushing to protect the control cable 50 against wear. After leaving this bore 55, the third control cable 50 forms a free activation loop 59, which can be grasped by the user without difficulty. From the end of the activation loop 59 opposite the bore 55, the control cable 50 extends through an addition bore 61 arranged adjacent the bore 55 back into the interior of the cross rail 20, where it is guided over diverting devices 53 and 57 formed like the diverting devices 46 and 48. From these diverting devices 53 and 57, the third control cable 50 extends in the cross rail 20 to an additional side diverting roller 52 which is arranged beneath the lower end of the associated guide rail 14, aligned roughly with the control area of its chamber 18. From this diverting roller 52, the third control cable 50 extends to the spool 26, onto which a portion of the control cable 50 is wound, whereby the end of the cable is rigidly connected with the spool 26.

In the Figs. the roller shutter is illustrated in a partially drawn position. Therein, the connection point 47 of the control cable 40 and 42 is located within the buffer loop 43 spaced from the diverting roller 45, which is at least as large as the distance by which the shutter is drawn down from the completely open position. The further the roll shutter is drawn, the further the connection point 47 moves within the buffer loop 43 away from the diverting roller 45 toward the loop-forming roller 49, and after passing this loop-forming roller 49, toward the second loop-forming roller 51. The length of the buffer loop is such that it is larger than the shutter movement path between the completely open and completely closed positions, with a roll shutter provided for the longest window size. This assures that the connection point 47 will always be located within the area of the buffer loop 43 in all positions of the roll shutter.

To open the closed roll shutter, the user pulls on the end of the activation loop 59 adjacent the second bore 61. As this is done, the section of the control cable 50, which was wound onto the spool 26 when the roll shutter was closed, is pulled back off of the spool, whereby the winding shaft 24 is rotated in the direction in which the roll shutter plating is wound on thereto. To close the opened roll shutter the user pulls on the other end of the activation loop 59, adjacent the bore 55, by which means the control cables 40 and 42 are together pulled around the diverting roller 45 and the connection point 47 is increasingly further removed from the diverting roller 45 within the buffer loop 43.

The activation of the roll shutter is possible, both when the window is open and closed, because the position of the cross rail 20 relative to the lower piece of the frame of the hinged casement 2 does not change. As shown in FIG. 4, a pivoting of the hinged casement 2 results only in a longitudinal displacement of the upper section 30 of both guide rails 14 and a corresponding lateral displacement of the roll shutter frame 22.

All characteristics mentioned in the above specification, as well as all characteristics which can be gathered only from the drawings, are components of the invention as further embodiments thereof, even if they are not separately emphasized, and particularly, if they are not mentioned in the claims.

I claim:

1. A roll shutter for a hinged casement type roof window, comprising:

a shutter frame;

a winding shaft arranged in the frame which supports a wound portion of the roll shutter plating;

two guide rails connected to the shutter frame parallel to each other, each forming a guide groove for the ends of the shutter and are divided at equal distances by the shutter frame, whereby the upper sections of the guide rails connected to the roll shutter frame are connected with the lower sections by respective hinges, the pivot axes of which run parallel to the pivot axis of the hinged casement;

a cross rail connecting the lower sections with each other at their ends opposite the shutter frame;

a roll shutter activation device having a first and a second control cable, which are connected to the lower end of the roll shutter at equal distances from the center of the roll shutter and each of which runs in one of the two guide grooves in the guide rails and past diverting elements provided in the area of the cross rail and through a bore in the frame of the hinged casement and are connected with one end of an activation loop which can be grasped by the user, a third control cable being connected to the other end of the activation loop, said third control cable passing through a bore in the frame in the hinged casement, with the winding shaft, a spool onto which the end of this third control cable is wound, said spool being fixed to the winding shaft;

wherein in the area of the cross rail, first and second loop-forming rollers are provided in addition to the diverting elements, which rollers serve to form a buffer loop, the loop length of which is at least as large as the displacement path of the roller shutter between the entirely closed and entirely opened positions, and wherein the lengths of the first and second control cables attached to the lower end of the roll shutter are selected such that their connection point, at which they are attached to each other and are connected with the third control cable running to the spool, is located within the buffer loop when the roll shutter is completely open and completely closed and;

wherein said diverting elements are located within said guide rails at opposite sides of said frame, said first and second loop-forming rollers are located at opposite sides of said frame, and said connection point is free to move within said buffer loop to any point between one of the diverting elements and the loop-forming roller located on the same side of the frame, passing over the loop-forming roller located on the opposite side of the frame, as the roll shutter is completely opened and completely closed.

2. The roller shutter according to claim 1, wherein one of the diverting rollers associated with the diverting elements, which roller is arranged in a corner area of the cross rail, lead the first and second control cables together to the buffer loop, which is connected to said diverting roller, and in that the first loop-forming roller is arranged in the corner area of the cross rail lying opposite said one diverting roller and the second loop-forming roller is arranged in the same corner area of the crossrail as the said one diverting roller.

3. The roll shutter according to claim 1 or 2, further comprising two mounting bolts provided to secure the upper sections of the guide rails in positions in which they are at least closely adjacent the side pieces of the window frame, each of which mounting bolts overlaps one of the upper side edge areas of the sections and which mounting bolts are connected with the associated side pieces of the window frame.

4. The roll shutter according to claim 3, wherein each mounting bolt is connected to a side rail connected with the associated side piece of the window frame and extends parallel to the pivot axis of the hinged casement.

5. The roll shutter according to claim 4, wherein the side rails have an L-shaped cross section, and extend at least over a large portion of the length of the associated section of the guide rails and the side piece of which runs in the plane lying perpendicular to the pivot axis of the hinged casement, supports the mounting bolts.

6. The roll shutter according to claim 1, wherein the shutter frame has a shape approximating the round form of the coil of the wound shutter plating.

7. The roll shutter according to claim 6, wherein said shutter comprises a wall and the wall of the shutter frame is divided into a plurality of flat wall sections, which form obtuse angles with the respective adjacent wall sections.

8. The roll shutter according to claim 7, wherein the shutter frame includes internal wall sections which abut each other to form right angles, and in that at least one plastic strip is provided along one of these corner areas in the internal chamber of the shutter frame, which strip has a triangular cross section.

9. A roll shutter for a hinged casement window, comprising:

a shutter frame into which the shutter can be rolled;

a longitudinal guide rail mounted on each side of said frame, each of said guide rails having a guide groove in which the shutter can travel;

the hinged casement window being arranged between the guide rails and having a pivot axis perpendicular to the longitudinal direction of the guide rails;

each of said guide rails being adapted to pivot adjacent the pivot axis of the casement window;

a control cable connected to each side of the shutter and arranged within a respective guide rail;

diverting elements provided within each of said guide rails at the ends of the guide rails opposite the shutter frame and around each of which diverting elements one of said control cables passes;

a third control cable being interconnected to the control cables at the end of said guide rails opposite the shutter frame to form a connection point;

rolling means within the shutter frame for rolling the shutter into the frame, said rolling means being interconnected to the third control cable;

said roll shutter further comprising loop forming rollers around which said third control cable forms a buffer loop, said buffer loop having a loop length which is at least as large as the displacement path of the roll shutter between the entirely closed and entirely opened positions of the roll shutter wherein said loop forming rollers are located within said guide rails at opposite sides of said frame, and said connection point is free to move within said buffer loop to any point between one of the diverting elements and the loop-forming roller located on the same side of the frame, passing over the loop forming roller located on the opposite side of the frame, as the roll shutter is completely opened and completely closed.

10. The roll shutter according to claim 9, wherein a lower section of each guide rail is connected to the casement window and moves therewith.

11. The roll shutter according to claim 10, further comprising a frame for the casement window, an upper section of each of the guide rails being slidably mounted to the window frame.

12. The roll shutter according to claim 11, further comrprising side rails mounted to the window frame and bolts mounted on said side rails, the upper section of the guide rails being adjacent the frame by the bolts.

* * * * *